United States Patent [19]

Holden et al.

[11] 4,450,650

[45] May 29, 1984

[54] ACTION PLAY TOY

[76] Inventors: John E. Holden, R.D.#1, Lime Ridge Farm, Mount Joy, Pa. 17552; Fred D. Eddins, P.O. Box 498, Tarklin Rd., Pole 90, Mapleville, R.I. 02839; Richard W. Kimbrough, 35 Tinker St., Woodstock, N.Y. 12498

[21] Appl. No.: 420,880

[22] Filed: Sep. 20, 1982

[51] Int. Cl.[3] ..... A63H 7/00; A63H 33/00

[52] U.S. Cl. ..... 46/17; 46/204; 46/47; 46/112

[58] Field of Search ..... 46/22, 202, 204, 205, 46/112, 47, 120, 119, 118, 17

[56] References Cited

U.S. PATENT DOCUMENTS

| | | | |
|---|---|---|---|
| 525,716 | 9/1894 | McElroy | 46/119 |
| 820,843 | 5/1906 | Arnold | 46/118 |
| 2,804,720 | 9/1957 | Olson | 46/120 |
| 2,927,467 | 3/1960 | Sala | 46/118 |
| 3,147,566 | 9/1964 | Liu Hong Ong | 46/119 |
| 3,305,966 | 2/1967 | Thornell | 46/112 |
| 3,768,199 | 10/1973 | Goldfarb | 46/119 |
| 3,911,614 | 10/1975 | Terzian | 46/120 |
| 3,961,440 | 6/1976 | Saito | 46/206 |
| 4,189,864 | 2/1980 | Saito | 46/202 |
| 4,261,136 | 4/1981 | Tsui | 46/112 |
| 4,270,305 | 6/1981 | Samuels | 46/201 |

*Primary Examiner*—Robert A. Hafer
*Assistant Examiner*—Paul S. Polakowski
*Attorney, Agent, or Firm*—Salter & Michaelson

[57] ABSTRACT

An action play toy which includes a housing having a plurality of apertures therein and a plurality of action elements and three dimensional elements which are detachably received in the apertures. A gear assembly in the housing interconnects the action elements for simultaneous rotation and a bell assembly in the housing produces interesting sound in response to rotation of the gear assembly. The toy is adapted for assembly by a child with action and three dimensional elements of a variety of configurations, as desired.

3 Claims, 7 Drawing Figures

ACTION PLAY TOY

BACKGROUND AND SUMMARY OF THE INVENTION

The instant invention relates to action toys and more particularly to a novel action play toy which is adapted for assembly in a variety of different interesting configurations.

The concept of providing a play toy having a plurality of mechanically interconnected action elements which provide animation or movement in the toy is well known in the toy art. Action toys having two or more interconnected action elements have been embodied in a variety of types of toys including miniature vehicles as well as many other toy configurations.

The instant invention provides a novel and amusing play toy of this general type which is structurally unique and which is adapted for assembly in a variety of different interesting configurations which include different combinations of interesting action and/or three dimensional elements. Consequently, the device of the subject invention provides a source of amusement for children in the assembly thereof by providing a medium for imaginative and creative expression. The assembled toy provides further amusement in its use and operation with its various action elements.

The toy of the subject invention generally comprises a housing having a plurality of apertures therein, a plurality of rotatable socket elements which are disposed within the housing and communicate with the exterior thereof through the apertures and a base for mounting the housing on a supporting surface. A plurality of hub members are mounted within the housing in substantially coaxial relation around at least a portion of the socket elements so that they communicate with the exterior of the housing through at least a portion of the apertures. A gear assembly in the housing interconnects the socket elements so that rotation of one thereof causes rotation of the others thereof, and a plurality of action elements are detachably received in the socket elements for rotation therewith on the exterior of the housing. One or more stationary three dimensional elements are detachably received in engagement in the apertures. Accordingly, the toy may be assembled by a child as desired by positioning various combinations of the three dimensional elements and action elements in the apertures so that the action elements rotate while the three dimensional elements remain stationary.

Also included in the toy is an impact responsive bell assembly which is mounted in the housing and is responsive to rotation of the gear assembly to produce a ringing sound. The bell assembly includes a bell and a clapper which preferably comprises a resilient coil spring base member having a hammer element attached to the end thereof. A radially extending finger element of the bell assembly rotates with the gear assembly to first deflect the clapper and then release it. As the clapper is released, the coil spring thereof produces a twanging sound, and immediately thereafter, the hammer element impacts the bell to effect a ringing thereof. The combination of the two types of interesting sounds produced by the bell assembly adds a further interesting dimension to the toy of the instant invention.

In one embodiment of the toy, the base is detachably secured to the housing and includes a plurality of wheels and a base gear assembly which interconnects the wheels to the housing gear assembly. Hence, movement of the toy on a supporting surface causes rotation of the wheels and corresponding rotation of the action elements on the housing through the two gear assemblies.

Accordingly, it is an object of the instant invention to provide an action play toy which is adapted for assembly in a variety of amusing and interesting configurations.

A still further object of the instant invention is to provide an action play toy having a plurality of detachable action elements, an impact responsive sound element and a coil spring clapper which is adapted to impact the sound element.

Other objects, features and advantages of the invention shall become apparent as the description thereof proceeds when considered in connection with the accompanying drawings.

DESCRIPTION OF THE DRAWINGS

In the drawings which illustrate the best mode presently contemplated for carrying out the present invention.

DESCRIPTION OF THE INVENTION

Figure 4:
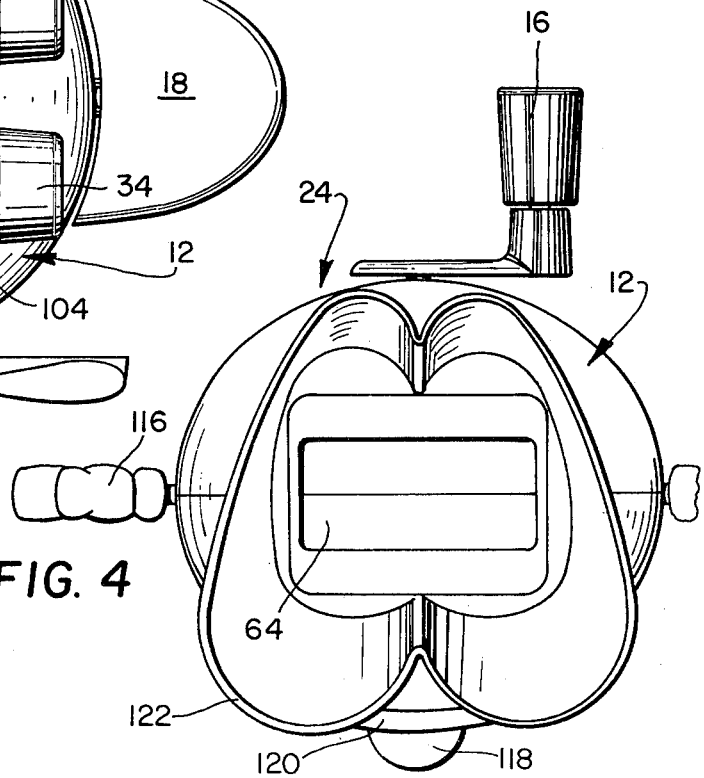
FIG. 4 is a bottom plan view of the second embodiment of the toy illustrated in FIG. 2.

Referring now to the drawing, particularly FIGS. 1, 3 and 5 through 7, a first embodiment of the action toy of the instant invention is illustrated and generally indicated at 10. The toy 10 includes an egg-shaped housing 12 and is embodied as an airplane-like toy having action elements which include a propeller 14 and a wind-up handle 16 and stationary three dimensional elements which include wings 18 and a tail section 20. The housing 12 is mounted on a base assembly generally indicated at 22 for movably supporting the toy 10 on a supporting surface. When the toy 10 is moved across a supporting surface, the propeller 14 and the handle 16 rotate to provide amusing movement in the toy 10. It will be understood, however, that the toy of the instant invention can be embodied in a variety of different configurations such as the toy generally indicated at 24 in FIGS. 2 and 4 which also includes the housing 12 but which has a variety of different action and three dimensional elements as will hereinafter be more fully described.

The toy 10 generally comprises the housing 12 which has a plurality of apertures therein, a housing gear assembly which is generally indicated at 26 and which is mounted in the housing 12, a pair of socket and hub assemblies which are generally indicated at 28, a shortened socket and hub assembly which is generally indicated at 30, a bell assembly which is generally indicated at 32, a base assembly 22 which includes wheels 34 and 35, the three dimensional elements 18 and 20, and the action elements 14 and 16. The housing gear assembly 26 provides mechanical interconnection among the hub and gear assemblies 28 and 30 and the base 22 so that rotation of one of the action elements 14 or 16 or of the wheels 34 and 35 causes rotation of the others thereof.

Figure 5:
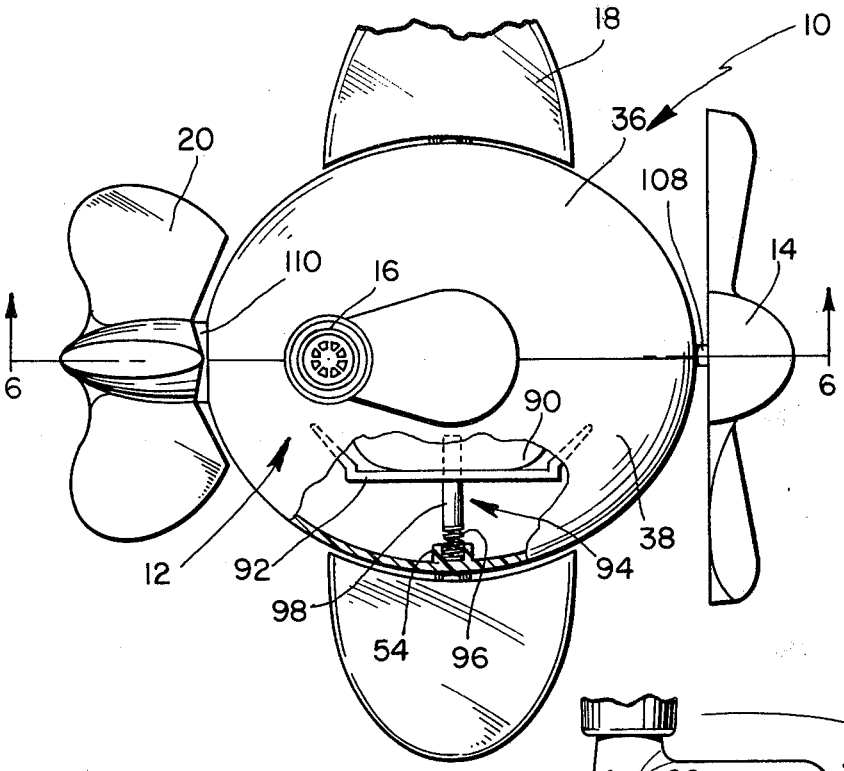
FIG. 5 is a top plan view of the first embodiment toy.
Figure 6:
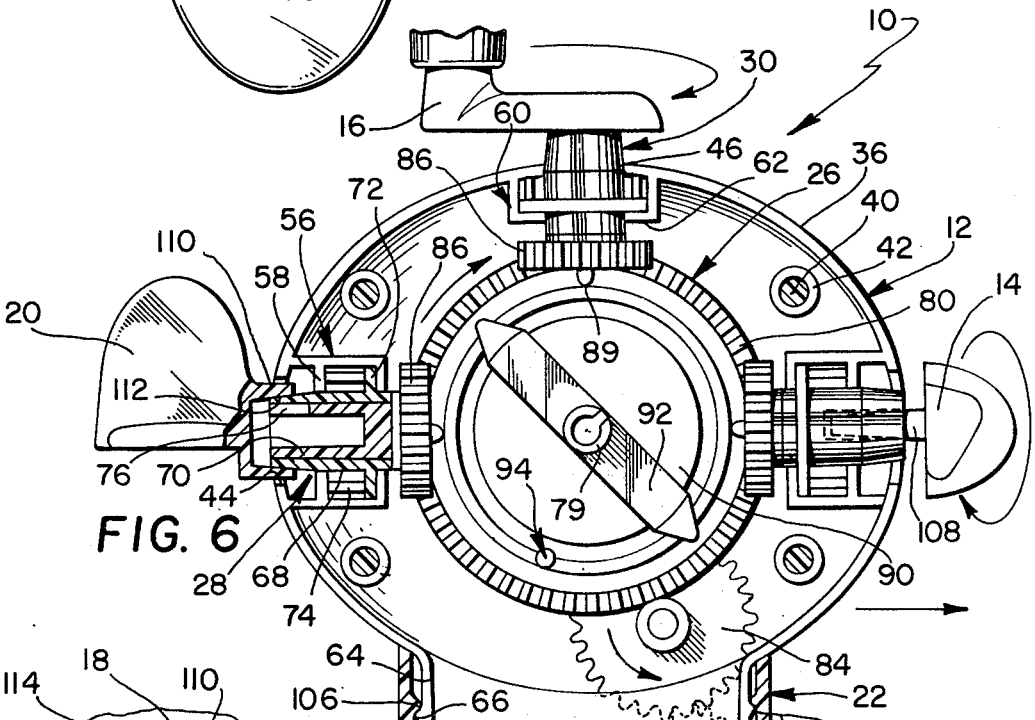
FIG. 6 is a side sectional view taken along line 6—6 in FIG. 5.
Figure 7:
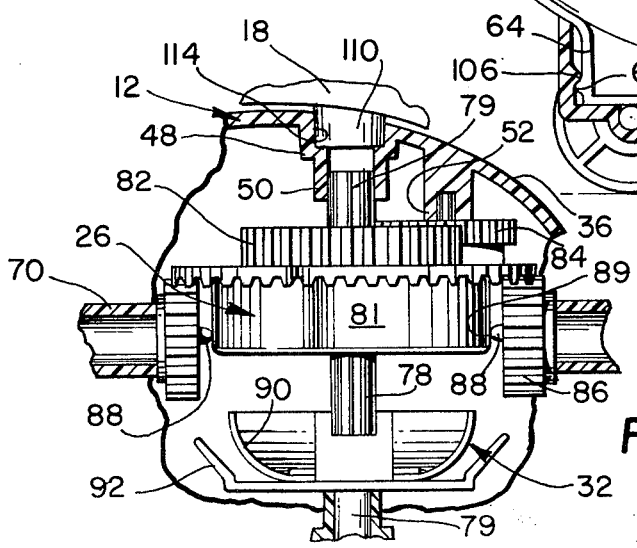
FIG. 7 is a top fragmentary sectional view of the gear assembly of the toy.

Referring particularly to FIGS. 5 through 7, the housing 12 comprises a pair of split housing halves 36 and 38 which are secured together in interfitting relation to define an egg-shaped body or shell for the toy 10. As illustrated in FIG. 6, alignment pins 40 are integrally molded in the half 38 and are received in alignment sleeves 42 which are integrally molded in the half 36 to maintain said halves in desired registry. Semicircular notches 44 are provided in the halves 36 and 38 at the ends thereof, and semicircular notches 46 are provided in the upper portions thereof, said notches cooperating to define apertures in the ends and the upper portion of the housing 12, respectively. As illustrated in FIG. 7, recesses 48 having inwardly projecting bosses 50 are provided in the side portions of the halves 36 and 38 and define additional apertures in the housing 12. Inwardly extending circular bosses 52 and 54 illustrated in FIGS. 7 and 5, respectively, are provided in the lower portions of the halves 36 and 38, respectively. Hub mounting portions 56 illustrated in FIG. 6 project inwardly adjacent the notches 44 in the halves 36 and 38 having transverse baffles 58 which define semicircular notches in said mounting portions. Similarly, shortened hub mounting portions 60 extend inwardly adjacent the notches 46 and have baffles 62 which define semicircular notches therein. The hub mounting portions 56 in the halves 36 and 38 cooperate to receive the hub and socket assemblies 28 and the mounting portions 60 cooperate to receive the hub and socket assembly 30 as will hereinafter be more fully brought out. Projecting downwardly from the lower portions of the halves 36 and 38 are foot portions 64 having detents 66 for receiving the base 22 on the housing 12.

The hub and socket assemblies 28, which are illustrated most clearly in FIG. 6, comprise outwardly tapered tubular hubs 68 and socket elements 70. The hubs 68 have radially extending flanges 72 and positioning posts 74 which extend from the flanges 72. The socket elements 70 have slots 76 adjacent the outer ends thereof and are rotatably received in the hubs 68 in substantially coaxial relation. The socket and hub assembly 30 is similar in configuration to the assemblies 28 although of slightly reduced length. The socket and hub assemblies 28 are received in the baffles 58 in the mounting portions 56 with the positioning posts 74 maintaining the hubs 68 in desired axial relation so that the assemblies 28 communicate with the exterior of the housing 12 through the apertures defined by the notches 44 for receiving action and/or three dimensional elements therein. The assembly 30 is similarly positioned in the mounting portion 60 so that it communicates with the exterior of the housing 12 through the apertures defined by the notches 46.

The gear assembly 26 comprises a main drive shaft 78 having sockets 79 on opposite extremities thereof, and a crown gear assembly comprising an integrally molded crown gear 80, a coaxially extending collar 81 and a main drive shaft gear 82 which is mounted on the shaft 78. The shaft 78 is journaled in the bosses 50 so that the sockets 79 communicate with the recesses 48. A base assembly drive gear 84 is journaled to the hub 52 and intermeshes with the main drive shaft gear 82. Pinion gears 86 are secured to the inner ends of the socket elements 70 and to the similar components (not shown) of the socket and hub assembly 30 and intermesh with the crown gear 80 to communicate rotational movement among the hub and socket assemblies 28 and 30. Inner knobs 88 provided on the inner sides of the pinion gears 86 engage the collar 81 as at 89 to maintain the pinion gears 86 in desired axial relation so that they intermesh with the crown gear 80. Accordingly, rotation of one of the pinion gears 86 or of the base assembly drive gear 84 causes corresponding rotation of the other gears 86 or 84.

Again referring to FIGS. 5 through 7, the bell assembly 32 is also mounted in the housing 12 and comprises a bell element 90 which is mounted on the shaft 78 for rotation therewith, a pair of radially extending finger elements 92 which are also mounted on the shaft 78 and a resilient clapper which is generally indicated at 94. The clapper 94 comprises a coil spring element 96 and a hammer element 98 which is secured to the end of the spring element 96. Upon rotation of the shaft 78, the fingers 92 engage the clapper 94 causing it to be deflected and then released to effect an impacting engagement of the hammer element 98 with the bell element 90. When the clapper 94 is released in this manner, the spring element 96 produces a twanging sound and immediately thereafter the hammer element 98 engages the bell element 90 to produce a ringing sound.

The base 22 comprises a rectangular open chassis 100, the wheels 34 and 35, axles 102 and axle gears 104. The axles 102 are journaled in the chassis 100 and the gears 104 and the wheels 34 and 35 are mounted on the axles 102. The gear 104 at the rear of the base 22 intermeshes with the housing drive gear 84 and hence provides communication with the gear assembly 26. It should be pointed out that the base 22 is symmetrical and can be alternatively mounted so that the other gear 104 is in communication with the gear 84. The base 22 is detachably secured to the housing 12, with detents 106 which cooperatively engage the detents 66 on the foot portions 64.

As illustrated in FIG. 6, the action elements 14 and 16 include tapered pins 108 which are dimensioned to be frictionally received in the socket elements 70, in the socket elements 79, or in the corresponding socket elements (not shown) of the socket and gear assembly 30. The three dimensional elements 18 and 20, on the other hand, have tubular neck portions 110 which are frictionally receivable in the apertures in the housing 12. In particular, the elements 18 and 20 are receivable in the apertures defined by the notches 44 or the notches 46 on the end and top portions of the housing 12 with the inner surfaces of the neck portions 110 frictionally engaging the outer surfaces of the hub elements 68 as at 112 or the corresponding outer surfaces of the hub element in the assembly 30. Alternatively, as illustrated in FIG. 7, the elements 18 and 20 are frictionally receivable in the recesses 48 with the exterior surfaces of the neck portions 110 engaging the inner walls of the recesses 48 as at 114.

In operation, one of the action elements 14 or 16 or the wheels 34 and 35 can be rotated to cause rotation of the others thereof, and communication therebetween is provided by the gear assembly 26. As the shaft 78 is rotated, the fingers 92 deflect the clapper 94, and the release it to cause an impacting engagement thereof with the bell 90. Further, in this connection, due to the unique configuration of the clapper 94, when it is released, the spring 96 first produces a twanging sound; and immediately thereafter the hammer element 98 strikes the bell 90, and produces a ringing sound. Accordingly, the toy 10 is adapted for providing interesting movement of the action elements and for simultaneously producing interesting sound.

Figure 1:
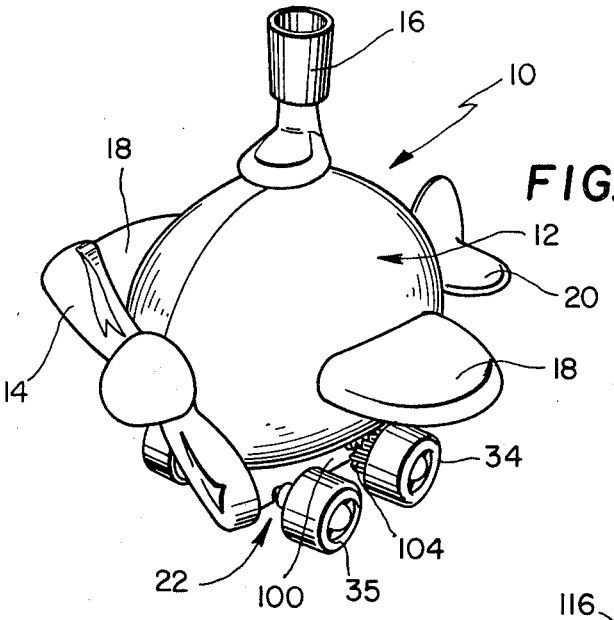
FIG. 1 is a perspective view of a first embodiment of the toy of the instant invention.
Figure 2:
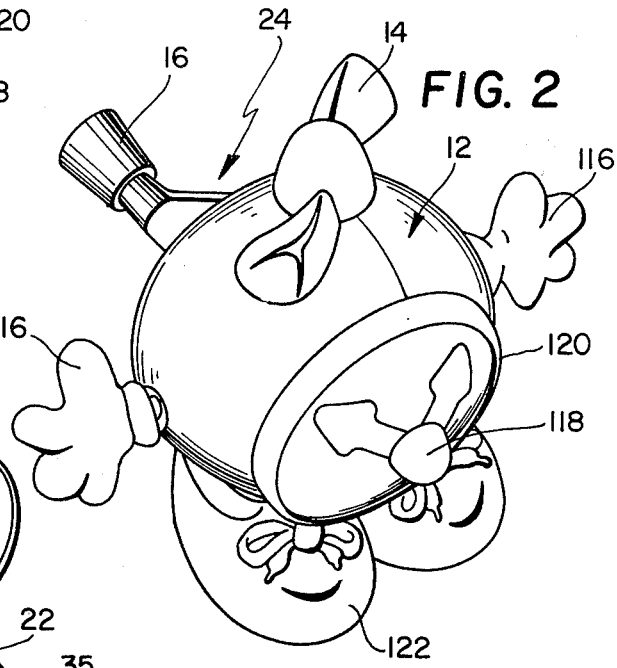
FIG. 2 is a perspective view of a second embodiment thereof.
Figure 3:
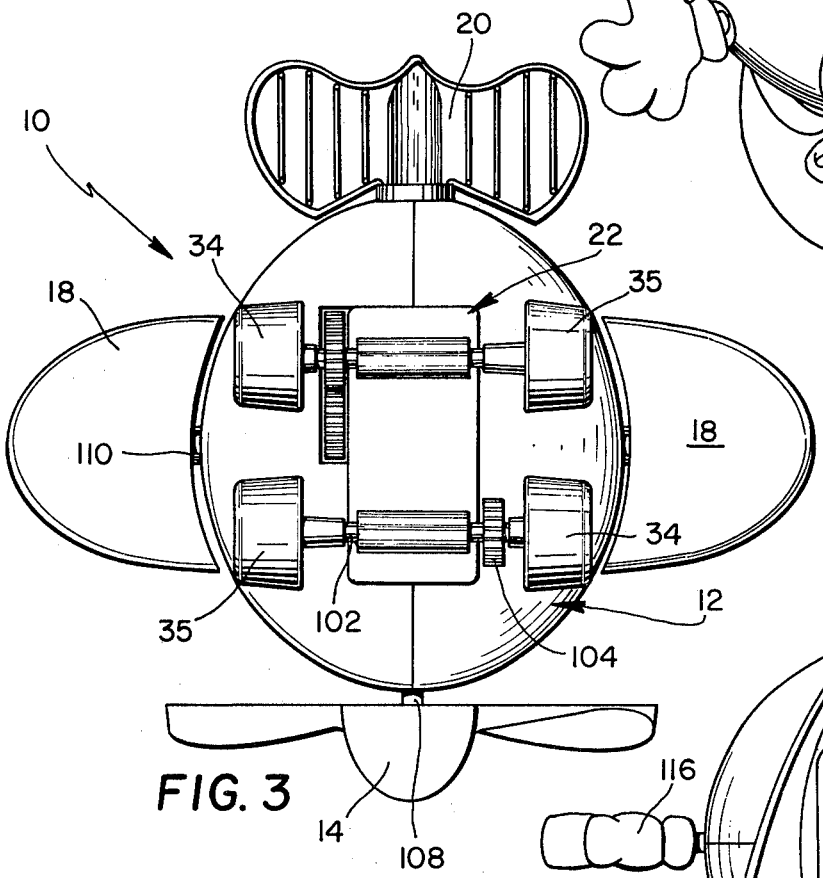
FIG. 3 is a bottom plan view of the first embodiment of the toy illustrated in FIG. 1.

The toy illustrated in FIG. 2 and generally indicated at 24 is an alternate embodiment of the instant invention and comprises the housing 12 having the gear assembly 26, the bell assembly 32 and the socket and hub assemblies 28 and 30 mounted therein. The toy 24 includes the action elements 16 and 14, although they are received in alternative apertures in the housing 12, as illustrated. The toy 24 further comprises a pair of action elements 116 which are received in the sockets 79 within the recesses 48, and an action element 118 which is received in one of the socket and hub assemblies 28. An apertured three dimensional element 120 is mounted on the front of the housing 12 in a manner similar to the elements 18 and 20 on the toy 10. Supporting the housing 12 of the toy 24 is a stationary base 122 which is received on the foot portions 64 in a manner similar to the base 22. Rotation of the element 16 in the toy 24 causes rotation of the elements 14, 116 and 118 to provide interesting movement in the toy 24 and simultaneously cause the bell assembly 32 to produce interesting sound therefrom.

The toy of the instant invention is adapted for assembly in a variety of different configurations and hence provides a young child with a medium for imaginative expression as well as aiding in the development of the child's manual dexterity. The toy may be assembled with various action elements and/or three dimensional elements to produce a variety of interesting and amusing combinations. The sound elements in the toy produce interesting sounds when the action elements of the toy are operated. Hence, the toy of the instant invention is capable of capturing a small child's attention for a prolonged period of time. For these reasons, the toy of the subject invention represents a significant advancement in the toy art which has substantial commercial significance.

While there is shown and described herein certain specific structure embodying this invention, it will be manifest to those skilld in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An action toy comprising:

a. a housing having a plurality of apertures therein;

b. a base secured to said housing for supporting same on a supporting surface;

c. a plurality of individual rotatable socket elements separate from each other and mounted in said housing and communicating with the exterior thereof through said apertures;

d. housing gear means mounted in said housing mechanically interconnecting said socket elements so that rotation of one of said socket elements causes rotation of the others thereof;

e. a plurality of non-rotatable hub members mounted in said housing, each of said hub members communicating with the exterior of said housing through one of said apertures, one of said socket elements being rotatably received in substantially coaxial relation in each of said hub members;

f. a three-dimensioned element on the exterior of said housing detachably received in engagement on the exterior surface of a hub member in one of said apertures; and g. a plurality of action elements on the exterior of said housing detachably received in said socket elements for rotation therewith.

2. In the toy of claim 1, said clapper means comprising:

(a) a resiliently deflectable elongated member mounted in said housing; and (b) a hammer element attached to a free end of said elongated member, said means for effecting impacting engagement of said clapper means with said sound element deflecting and then releasing said elongated member upon rotation of said housing gear means to effect impacting engagement of said hammer element with said sound element.

3. In the toy of claim 2, said elongated member further characterized as a coil spring which is secured at one end thereof to said housing, said hammer element being secured to the other end of said spring, said spring producing a twanging sound upon release thereof and said hammer element immediately thereafter engaging said sound element.

* * * * *